US005161713A

United States Patent [19]

English

[11] Patent Number: 5,161,713

[45] Date of Patent: Nov. 10, 1992

[54] TAMPER-EVIDENT ROTOR TOP

[75] Inventor: Brent English, Eau Claire, Wis.

[73] Assignee: Board of Regents of the University of Wisconsin System (UW -Stout), Menomonie, Wis.

[21] Appl. No.: 689,646

[22] Filed: Apr. 23, 1991

[51] Int. Cl.[5] ..... B67D 5/06

[52] U.S. Cl. ..... 222/23; 222/541; 222/555; 222/565; 220/257

[58] Field of Search ..... 222/23, 153, 480, 541, 222/548, 555, 565; 215/230, 251; 220/257, 265, 305

[56] References Cited

U.S. PATENT DOCUMENTS

| | | | |
|---|---|---|---|
| 3,129,860 | 4/1964 | Foster | 222/480 X |
| 3,163,314 | 12/1964 | Mauser | 220/305 |
| 3,486,665 | 12/1969 | LaCroce | 222/480 |
| 4,541,541 | 9/1985 | Hickman et al. | 222/480 X |
| 4,611,725 | 9/1986 | Kacalieff | 222/480 X |
| 4,792,054 | 12/1988 | Weidman | 222/23 |
| 4,793,500 | 12/1988 | Harding | 215/230 |
| 4,925,067 | 5/1990 | Zemlo et al. | 222/565 X |
| 4,941,592 | 7/1990 | Kitterman | 222/541 X |
| 4,957,211 | 9/1990 | Ekkert et al. | 215/230 |

*Primary Examiner*—Gregory L. Huson

*Attorney, Agent, or Firm*—Cushman, Darby & Cushman

[57] ABSTRACT

A tamper-evident end closure for dispensers, including a hermetically sealed base, a rotor having a normally occurring unrestrained non-flat shape, and a rotatable connection between the rotor and the base to hold the rotor on the base in a substantially flat condition so it can rotate. The rotatable connection is achieved by employing an annular attachment ring, formed on the rotor snap-fit into an annular groove molded into the base. The annular attachment ring is connected to the rotor by a frangible web, which will break or tear when an attempt is made to separate the rotor from the base. Because the rotor is formed with a normally occurring non-flat shape, tearing or breaking of the frangible web will allow a portion of the rotor, normally held by the attachment ring, to spring or bend toward its natural shape. This unrestrained portion provides striking evidence of the tampering attempt.

16 Claims, 5 Drawing Sheets

TAMPER-EVIDENT ROTOR TOP

FIELD OF THE INVENTION

The present invention relates to end closures for various types of dispensers, cans, and other forms of containers. More particularly, the invention relates to a tamper-evident closure for containers having rotary tops.

BACKGROUND OF THE INVENTION

In the field of containers and closures, there exist many containers having end closures designed to meet various consumer needs for dispensing foods, chemicals, and other various products. One such closure design is the rotary end closure disclosed in U.S. Pat. No. 2,954,148 to Corrinet, et al. Such a closure includes tamper evident, rupturable connections yet it provides an opening through which the contents of the container may ultimately be dispensed.

These rotor type end closures typically include a separate rotor movably attached to a base, with the base itself being attached to the end of the container by a convenient means such as an adhesive bond or a friction fit. The base generally includes one or more rupturable areas which, when broken, define one or more variously shaped openings or windows through which the contents of the container may then be dispensed. These rupturable areas preserve freshness prior to opening and provide evidence of tampering since the opening includes a rupturable connection that cannot be resealed. As disclosed in Corrinet, et al., this rupturable connection is provided in the form of frangible tabs on the base. These frangible tabs are helpful in securing the position of the rotor in a locked position which closes the dispensary openings provided in the base. This arrangement helps satisfy the consumer's desire to know that the contents of the container remain in the same condition they were in when the container was closed. If the tabs have been ruptured prior to purchase, adulteration may have occurred and the ruptured tabs provide evidence of rotor tampering.

The rotor generally includes openings matching those provided in the base. By manually rotating the rotor to a position where the rotor opening is aligned with the base opening, the contents of the container may be dispensed. In many of the known designs, the rotor is generally pivotally attached to the base by a centrally positioned hub or stem member. This stem can be part of either the rotor or the base and normally would allow the rotor to be snap-fit on to the base or be otherwise rotatably connected together. Alternatively, the rotor could be retained in place by an undercut peripheral edge as in Corrinet et al.

While the frangible tabs discussed above in Corrinet, et al. provide some indication that the package may have been tampered with by opening the closure in the normal manner, that is by rotating the rotor relative to the base, such a system does not provide any readily perceivable indication to the consumer whether the base and rotor have been pulled apart in some other manner or that the rotor may have been separated from the base without relative rotation. Thus, without rupturing the frangible member a tampering effort could still take place. In Corrinet, et al., when the rotor is pulled or raised vertically off the base, the opening 25 in the base is exposed and the contents may be adulterated through that opening. Once the rotor is reinstalled, there is no indication that the container has been tampered with since the rotor is merely snap-fit into the undercut edge provided about the periphery of the base upper surface.

Several designs, such as those disclosed in U.S. Pat. No. 4,541,541 to Hickman, U.S. Pat. No. 4,792,054 to Weidman, and U.S. Pat. No. 4,611,725 to Kacalieff, have all attempted to overcome this problem by providing closures capable of indicating attempts to tamper with the closure. Each of these designs employ a base and rotor combination utilizing a central hub as the pivotal connection therebetween. As a result, it would be up to the consumer to carefully study the hub of the end closure for any possible damage evidencing a tampering attempt. This may not be possible.

Still other closure structures are shown in U.S. Pat. No. 4,549,667 to Dullabaun, U.S. Pat. No. 2,780,395 to Schlabach et al, U.S. Pat. No. 3,239,111 to La Croce and U.S. Pat. No. 3,389,840 to Musel et al.

SUMMARY OF THE INVENTION

Given the above shortcomings, one object of the present invention is to provide a new end closure for containers which is both easily manufactured, tamper-resistant and very tamper-evident. The end closure of the present invention includes a tamper-evident dispenser end closure that has a normally occurring shape other than flat, such as, for example, a concave or convex shape or perhaps one that had a variety of preformed shapes. The rotor is rotatably connected to the base through the use of a frangible section or connection that will hold the rotor in place under normal usage, allow the rotor to rotate relative to the base and yet retain the rotor in a suitably flat condition on the base whereby the rotor's normal preformed shape will not occur. However, if an attempt is made to remove the rotor, the frangible rotor retainer will break and at least a portion of the rotor will return to its preformed normal shape. Thereafter, due to that shape it will not be reinstallable and the attempt to remove the rotor will not go unnoticed.

As a result of its unique design, the rotor portion of the present invention provides a rotor top dispenser capable of providing the ultimate end user with glaringly obvious evidence of attempts to enter the container or attempts to open the closure by removal of the rotor from the base.

This evidence is presented to the consumer in such a manner that there will be no need for a careful examination of the closure since at least a portion of the rotor will have its otherwise flattened condition changed relative to the base.

While the present invention can be used to eliminate the use of hubs and stems as the form of connection between the rotor and the base, the concepts herein disclosed could function to disform a hub retained rotor.

Other objects, features, and characteristics of the present invention will become apparent upon consideration of the following description in the appended claims with reference to the accompanying drawings, all of which form a part of the specification, and wherein referenced numerals designate corresponding parts in the various figures.

DETAILED DESCRIPTION OF THE PREFERRED EXEMPLARY EMBODIMENT

Figure 1:
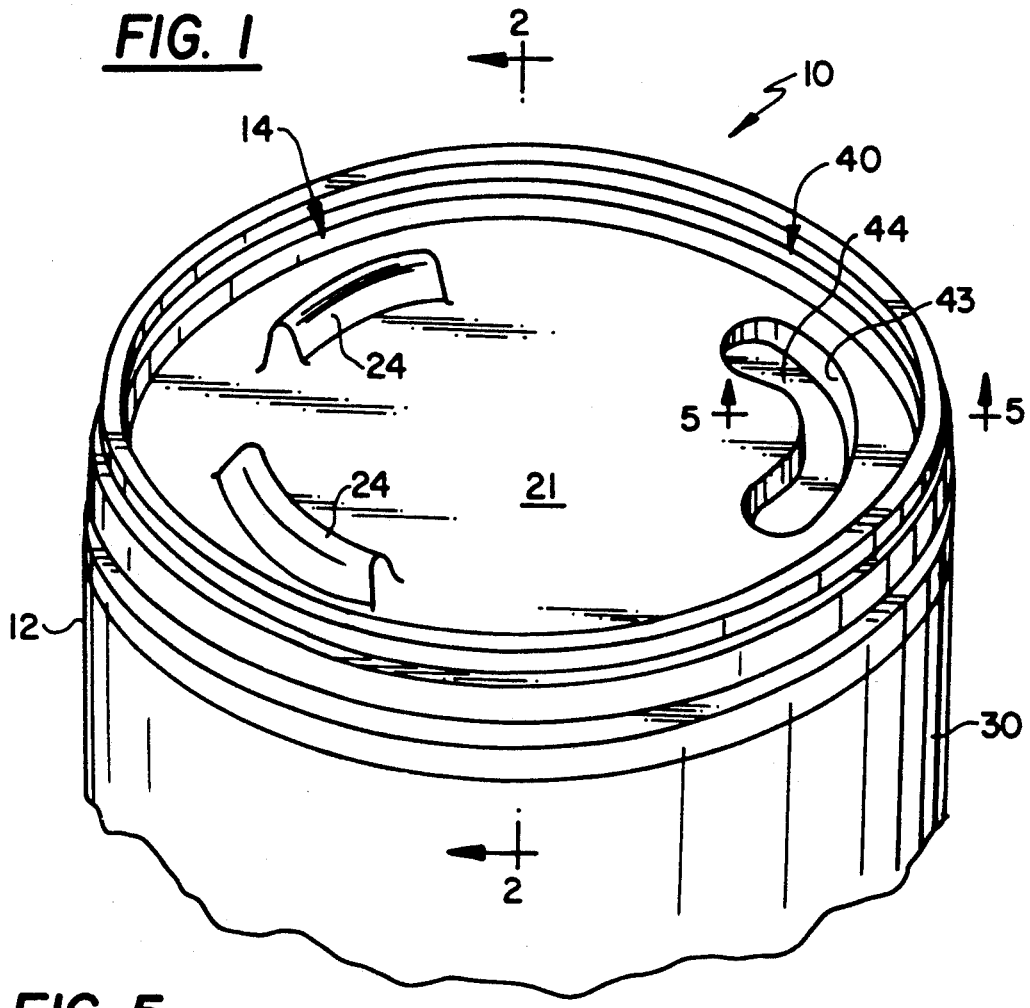
FIG. 1 is a top perspective view of the top end of a container having a rotatable end enclosure according to the present invention.

A dispensing container for holding various types of food products, including cheese, mixes, creamer, sugar and the like, chemicals, granulated, powdered material or other dispensable products and the like is indicated generally in FIGS. 1 at 10. The container 10 includes a depending side wall 30 and a conventional bottom end closure (not shown). The upper end 12 of the container is sealed by an end closure system, generally shown 15 at 14, comprised of a base 40 and a rotor 20. Rotor 20 is mounted on base 40 so that it is capable of being manually rotated relative to base 40. This will be more fully described hereafter. Rotor 20 and base 40 are both typically constructed of an injection-molded plastic such as, for example, polystyrene or polypropylene, but they could also be constructed of other man-made materials, or other formable materials. The rotor and base may be formed of the same material or from differing materials. For example, the base could be aluminum and the rotor plastic.

Figure 5:
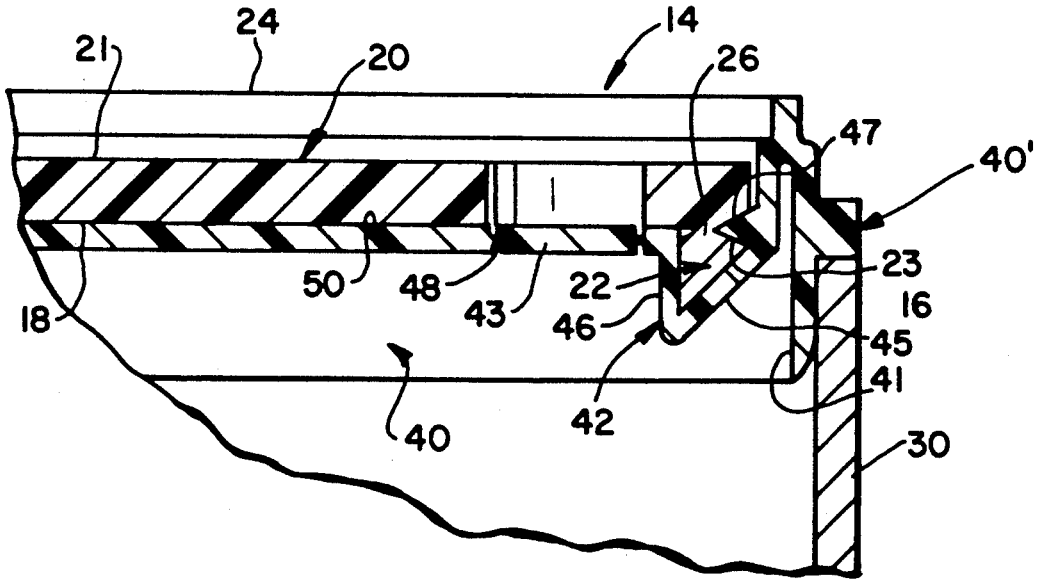
FIG. 5 is a partial cross-sectional view taken along line 5—5 of FIG. 1.
Figure 2:
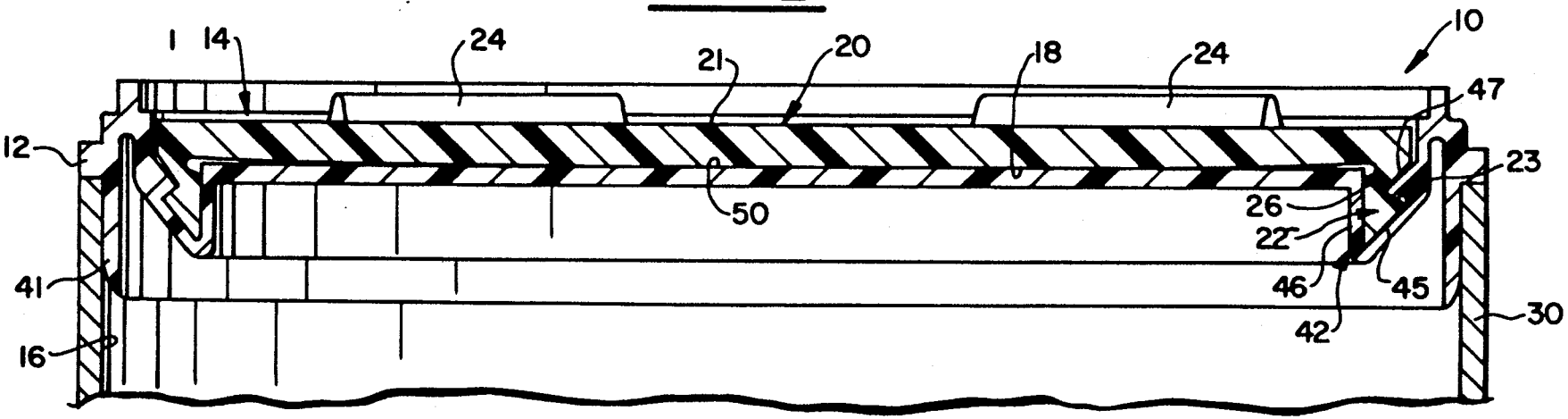
FIG. 2 is a cross sectional view taken substantially along line 2—2 of FIG. 1.
Figure 8:
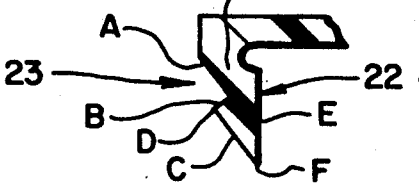
FIG. 8 is a detail of the attachment ring showing the various surfaces thereof.

Base 40 includes an outer side wall, generally indicated at 40', including a depending flange 41, as shown in FIGS. 2 and 5. Flange 41 engages the inner surface 16 of side wall 30. The flange 41 and inner surface 16 are typically friction-fitted, adhesively bonded or otherwise securely connected together by any known conventional means. Adhesive bonding is the preferred method of providing a hermetic seal between the base 40 and the side wall 30. Such a hermetic seal prevents leakage, spoilage or contamination of the contents of the dispensing container 10 as well as assuring that there cannot be any removal of the end closure base from the container.

As best illustrated in FIG. 5, base 40 can include an upwardly opening annular groove 42 extending about the periphery of the base. In one exemplary embodiment, groove 42 has a generally V-shaped cross-section. The central portion of base 40 is comprised of horizontally-extending wall section 50 extending across the majority of the base. Annular groove 42 includes an angled lower wall 45, a substantially straight, vertically extending interior wall 46 that is preferably integrally connected to wall 50. An annular bead 47 is positioned at the upper end of angled side wall 45. Bead 47 extends radially inwardly and actually overlies a portion of annular groove 42. Above and beyond annular bead 47 lies the remaining portion of the side wall 40' of base 40.

Figure 3:
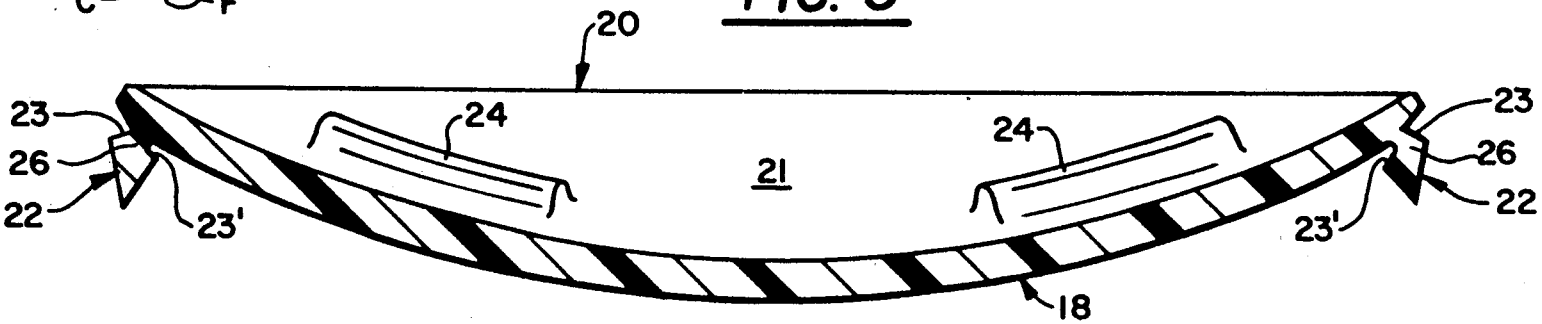
FIG. 3 is a cross sectional view taken substantially along line 3—3 of FIG. 2 showing only the rotor in its naturally formed state.

FIG. 3 depicts the unrestrained rotor 20 in an exemplary cross-sectional shape. Other cross-sectional shapes are possible and will be discussed below. Located on the upper surface 21 of rotor 20 can be one or more elongated members 24 that extend vertically upwardly from the upper surface of 21 thereon. Members 24 are added to assist in the manual rotation of rotor 20 relative to base 40 and their number, height, exact placement and shape are variables that can be determined to suit any number of end closure design requirements.

Since the rotor 20 will be formed in a normal, preformed shape other than flat, the rotor will have to be restrained to establish the desirable flattened shape when operatively positioned on base 40. One way to accomplish that restraint is through an attachment ring or ring segment, generally indicated at 22, which depends from the bottom, peripheral surface 18 of rotor 20. Attachment ring 22 includes, on either its inner or, as shown in FIG. 2, on its outer edge a frangible web 26 forming a groove 23 between rotor 20 and ring 22.

Groove 23 is defined by an upper angled surface A and a lower angled surface B. The bottom of ring 22 includes an angled surface C to allow for easy entry of the ring 22 into groove 42 provided in base 40 when the rotor 20 is installed. A point D is defined at the juncture of surfaces B and C. The interior surface of ring 22 is shown at E and the juncture of surfaces C and E define a point F.

It should be understood that the exact cross-sectional configuration of the groove 23 and surfaces A, B, C and E, as well as the cross-sectional shape of the ring receiving groove 42 in base 40, are not critical so long as the rotor is restrained in a flat or flattened condition in a way that still permits relative motion between base 40 and rotor 20. It is also important to restrain rotor 20 from moving into its normal shape and to provide a frangible area 26 between the main body of ring 22 and rotor 20. Thus, it is the reduced area between the innermost portion of groove 23 and surface E, a thinned area, that defines the frangible web 26 which is designed to break when an attempt is made to lift or pry up rotor 20 following installation.

The design could include two grooves 23 and 23', as shown, for example, on the left side of FIG. 3. The cross-sectional shape of the grooves used to define the frangible web could have a variety of shapes, such as, for example, a V-shape, as well as curved or squared interior shape configurations. The frangible area should be formed between the main part of the rotor and the retaining member, regardless of its shape, and the frangible area should be strong enough to hold the rotor flat and in place without breaking under normal usage, yet be weak enough to break should the rotor be raised upwardly. In such an event, the bead 47, positioned within groove 23, would engage surface B and prevent the removal of ring 22 from groove 42 with a force greater than that necessary to break the frangible web 26.

Groove 23 is desirably an annular groove located between the greater mass of attachment ring 22 and the bottom surface of rotor 20. The base 40 and rotor 20 are rotatably connected by snap-fitting the attachment ring 22 into the annular groove 42. As explained above, and as is best shown in FIG. 2, attachment ring 22 and annular groove 42 fit together with bead 47 fitting within groove 23. This arrangement forms a pivotable or movable connection between the base 40 and the rotor 20 that holds rotor 20 flat against base 40 yet permits relative movement between those two elements.

The thickness of the frangible web 26 may vary from material to material, but would typically be between 0.004 and 0.007 inches and must be sufficient to hold rotor 20 in place while permitting normal rotation when using the container. However, this thinned wall area, frangible web 26, should be sufficiently reduced in cross-section to break if the rotor 20 is lifted or pried upwardly. Breakage of frangible web 26 occurs before the snap-fit connection between rotor 20 and base 40 can be pulled apart. It should be noted that the attachment ring 22 may be continuous or alternatively comprised of discontinuous segments positioned at spaced apart intervals around its whole diameter to provide sufficient holding forces to keep rotor 20 in place on base 40. Similarly, bead 47 could be continuous or segmented so long as it complements ring 22. It should also be stated that the frangible area need not be structure connected solely with rotor 20. Alternatively, the frangible area could be built into bead 47, a portion of the structure forming groove 42 or elsewhere on the rotor or base so long as the frangible connection releases the otherwise restrained rotor when an attempt is made to break open the closure.

As depicted in FIG. 3, one exemplary embodiment of the rotor of the present invention is to mold the rotor with a normally, unrestrained, concave shape. This normally occurring shape could alternatively be convex, a twisted orientation or a shape into which a restrained rotor could revert to once the restraining forces were released.

A typical, but exemplary, radius of curvature for the concave shape of the rotor would be between four and eight inches. Because the rotor is constructed so as to be concave like the bottom half of a sphere whenever a tampering attempt causes a portion of the frangible web 26 to break or tear away from a portion of rotor 20, the unstrained portion of rotor 20 will bend and spring back into its normal concave shape. This pulls at least that portion of rotor 20 upwardly away from base 40 producing highly visible evidence of the lifting of the rotor and perhaps of a tampering attempt. It should be noted that given the normal concave shape of rotor 20, it would be very difficult, if not impossible, to flatten the rotor or otherwise hide the tampering attempt once the frangible web 26 is broken.

It should also be understood that ring 22 or the frangible area could be positioned inboard from the rotor's peripheral edge than is depicted in FIG. 2, such as, for example, along a path midway between the center and the peripheral edge such a shown by the dotted line in FIG. 1. All that is necessary is that rotor 20 be sufficiently retained on base 40 so that it will not assume its natural concave shape and be capable of normal rotational use.

Figure 4:
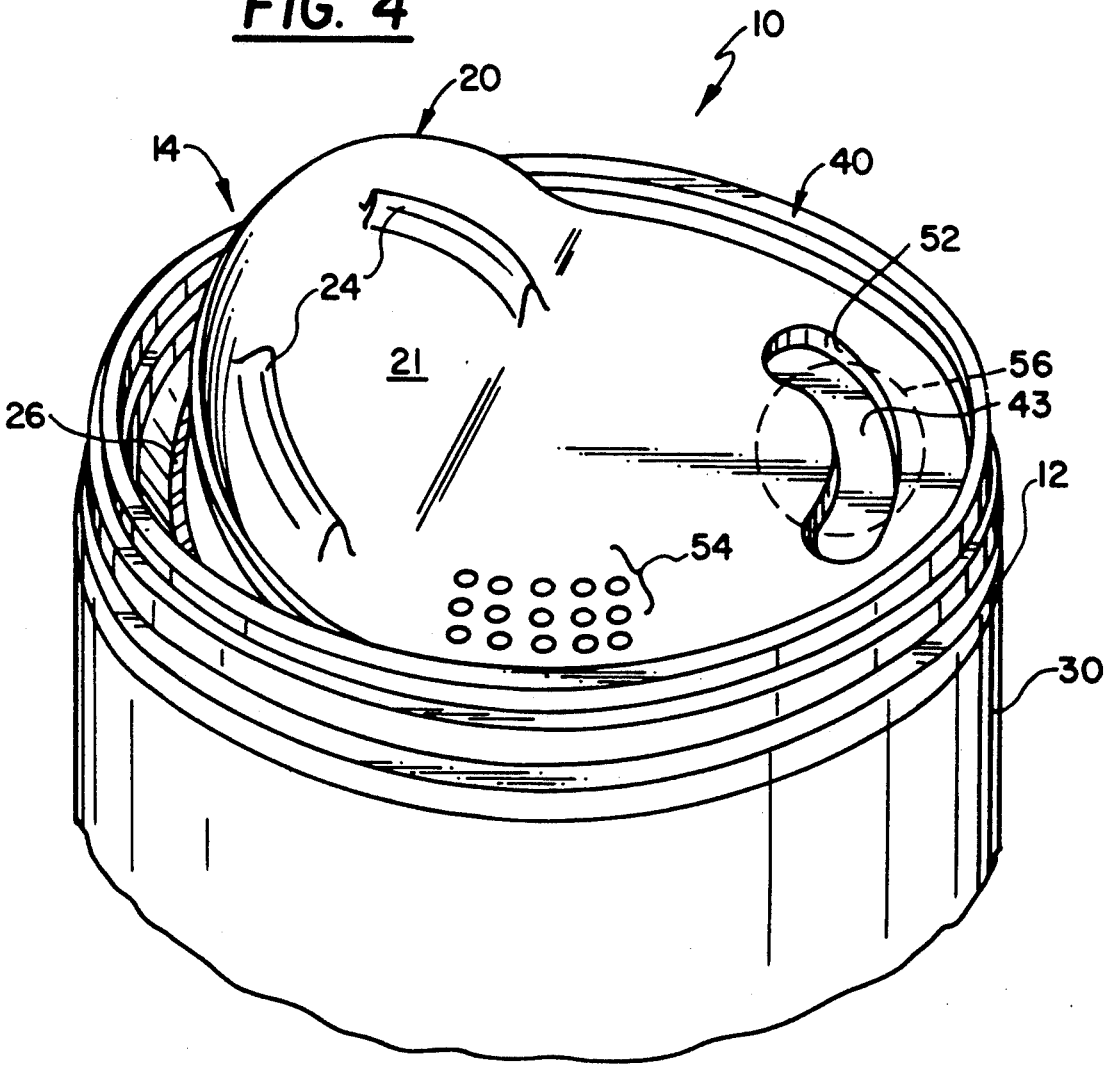
FIG. 4 is a top perspective view of a container having a rotatable end enclosure according to the present invention, with a portion of the rotor pulled away from the base showing the effects of a tampering attempt.

FIG. 4 illustrates the dispenser container 10 of the present invention following the lifting of the left side of rotor 20 as part of an attempt to break into the container. The left side of rotor 20 has been separated from ring 22 and has curled upwardly away from base 40.

It should be noted from FIGS. 1 through 4 that even if rotor 20 is pried up from the base 40, the horizontal surface 50 is a one-piece structure with no through openings provided therein and there is no post or hub holding rotor 20 in place. Thus, the bottom of rotor 20, when restrained, is preferably flat and the to of surface 50 is similarly flat. These two flat surfaces will remain substantially in sliding contact and will provide a suitable seal therebetween. Accordingly, the contents of the container 10 will still not be exposed to the tamperer even if the rotor 20 is completely removed and suitable sealing will be provided following opening by the purchasing consumer. This rotor design, however, will clearly show evidence of a tampering attempt and provides reassurance to a consumer when it remains in its proper position.

As depicted in FIGS. 1 and 4, the main horizontal section 50 of base 40 is provided with one or more push-out tabs 43 defined by a frangible web 48 perimeter having a substantially reduced wall thickness. Each tab 43 can be forced open by applying enough pressure to rupture the perimeter's frangible web. Depending upon how many push-out tabs are formed, one or more dispensing apertures can be created. FIGS. 1 and 4 also show that rotor 20 has preformed apertures therein. These openings can be shaped and sized to either exactly conform to the aperture created in the base, such as shown in FIGS. 4 and 5 for rotor aperture 52 or to have another yet complimentary shape for dispensing the contents safely from the container. The preformed rotor openings could have a shape different from that created in the base by either being larger or smaller, comprised of a plurality of openings, as indicated at 54, or could simply have a different shape such as shown at 56 in FIG. 4. Regardless of the rotor opening shapes, because the rotor apertures will overlie the base apertures following manual rotation of the rotor relative to the base, when alignment of the base and rotor apertures exists the contents of the container can then be dispensed.

Figure 6:
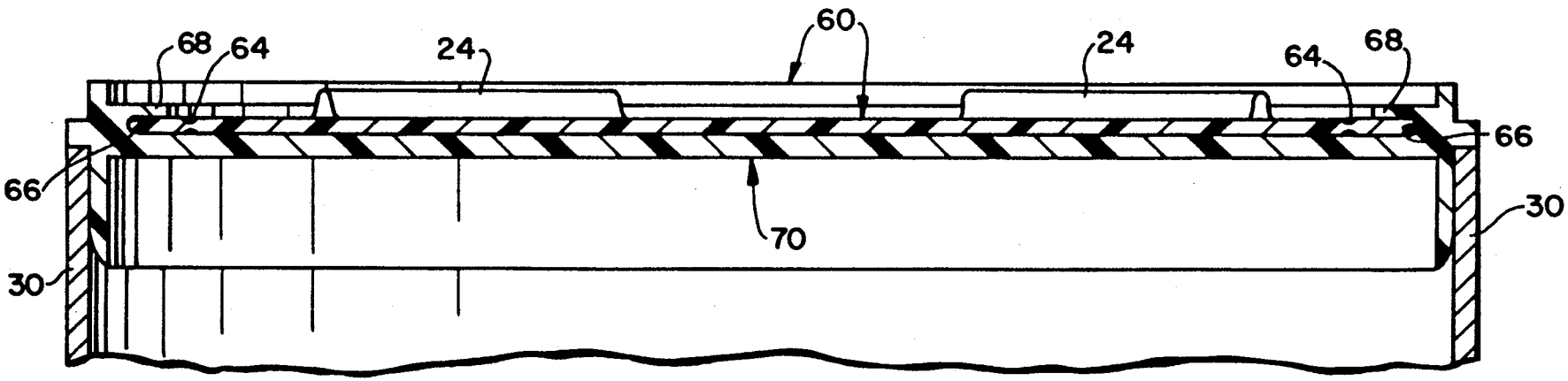
FIG. 6 is a cross-sectional view of an alternative embodiment for the rotor and base members.
Figure 7:
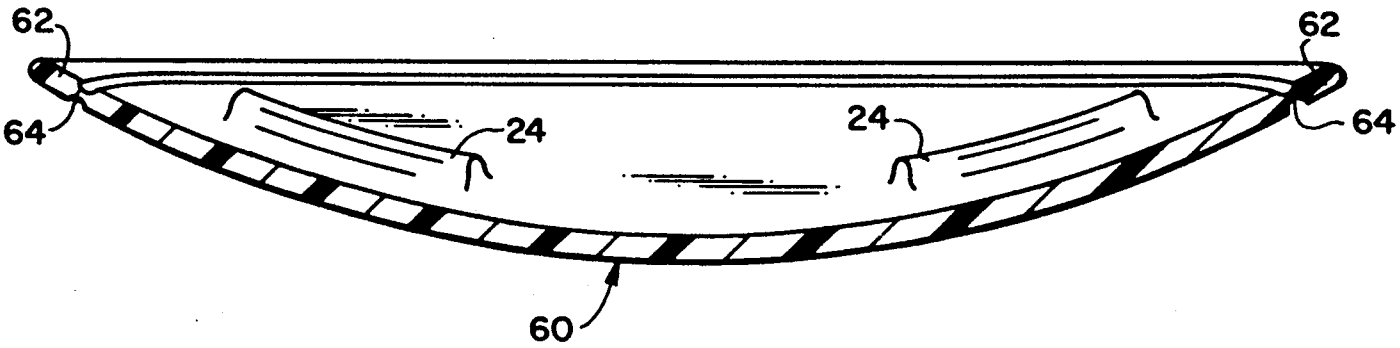
FIG. 7 is a cross-sectional view of the alternative rotor.
Figure 9:
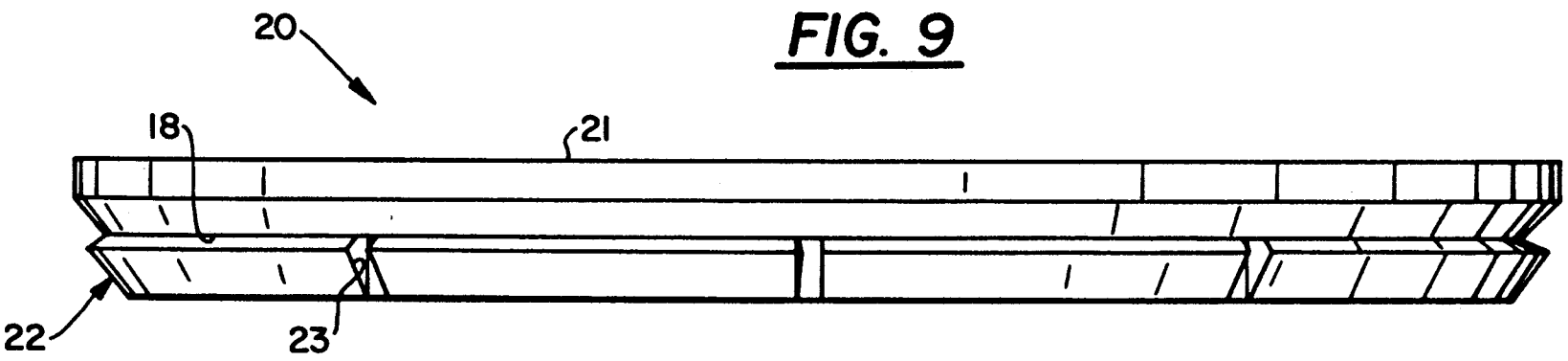
FIG. 9 is a perspective view of the rotor in a non-naturally occurring configuration and showing, alternatively, the attachment ring section as segmented.

With reference to FIGS. 6 and 7, an alternative approach for retaining the rotor 60 to base 70 is to employ or annular ring 62 that extends horizontally about and is attached to rotor 60 by a frangible web 64. Ring 62 is designed to fit within and be retained by an annular, undercut groove 66 in base 70. Groove 66 includes a radially inwardly extending annular flange 68 that overlies ring 62 sufficiently tightly so that any attempt to lift rotor 60 or to remove it from base 70 will fracture and break frangible web 64. Otherwise, the flange 68 will not interfere with normal rotation of rotor 60 relative to base 70 to open and close apertures in base 70. Ring 62 could be either continuous about the periphery of rotor 60 or it could be comprised of a series of discontinuous segments that would together hold rotor 60 in place. Also, the cross-sectional shape of ring 62 could be, for example, as shown, or circular, rectangular, oval or some other convenient shape.

From the above, it will be appreciated that the present invention provides an easy to manufacture and use rotor top dispenser capable of providing the consumer with glaringly obvious evidence of attempts to open, tamper or adulterate the contents, while also limiting the use of hubs and stems in such container.

While the invention has been described in connection with what is presently considered to be the most practical and preferred and embodiment, it is to be understood that the invention is not to be limited to the disclosed embodiment, but on the contrary, it is intended to cover various modifications and equivalent arrangements included within the spirit and scope of the appending claims.

What is claimed is:

1. A tamper-evident end closure for a container comprising:

a base;

a rotor having a normally occurring shape;

means for rotatably connecting the rotor to the base;

said means rotatably connecting further including a frangible retaining portion that normally retains said rotor on the base in an operative position and in a manner preventing the rotor from assuming said normally occurring shape whereby, upon breakage of said frangible retaining portion, the unrestrained portion of said rotor will return to the normally occurring shape.

2. An end closure according to claim 1, wherein the frangible retaining portion has a cross-sectional thickness of between 0.004 and 0.007 inches.

3. An end closure according to claim 1, wherein the base and the rotor are constructed of the same material.

4. An end closure as in claim 3 wherein the rotor and base are formed from plastic.

5. An end closure as in claim 1 wherein the rotor and base are formed from different materials.

6. An end closure as in claim 1 where the means rotatably connecting retains the rotor in a substantially flat condition.

7. An end closure as in claim 1 wherein said normally occurring shape is a concave shape.

8. An end closure as in claim 1 wherein said means rotatably connecting is positioned adjacent the periphery of said rotor.

9. An end closure as in claim 1 wherein said means rotatably connecting is positioned inboard of the periphery of said rotor.

10. An end closure as in claim 1 wherein said means rotatably connecting is formed from a continuous member extending about the circumference of said rotor.

11. An end closure as in claim 1 wherein said means rotatably connecting is formed from a plurality of discontinuous sections spaced about said rotor.

12. A tamper-evident dispensing enclosure comprising:

a base;

a rotor having a normally occurring shape;

means for rotatably connecting the rotor to the base in an operative position and in a manner preventing the rotor from assuming said normally occurring shape; said means rotatably connecting comprising an attachment ring, a frangible area connecting the attachment ring to the rotor, and an annular groove formed in the base adapted to slidably receive the attachment ring;

said frangible area being adapted to tear when an attempt is made to disengage the attachment ring from said annular groove so that upon tearing of the frangible area at least a portion of the rotor will return toward said normally occurring shape.

13. An end closure according to claim 12, wherein the attachment ring is formed as a continuous member.

14. An end closure as in claim 12 wherein said attachment ring is positioned adjacent the periphery of said rotor.

15. An end closure according to claim 12, wherein the attachment ring is formed from discontinuous sections positioned adjacent the periphery of the rotor.

16. A tamper-evident end closure for a container comprising a base, a rotor having a naturally occurring shape and means including a frangible connection between the rotor and base to secure the rotor to the base in an operative position and so that the rotor can rotate relative to the base and be restrained from said naturally occurring shape into a substantially flat condition unless said frangible connection is broken.

* * * * *